US010336116B2

(12) United States Patent
Tress et al.

(10) Patent No.: US 10,336,116 B2
(45) **Date of Patent: *Jul. 2, 2019**

(54) FUSER FOR ELECTROPHOTOGRAPHIC PRINTING HAVING RESISTIVE TRACE WITH GAP

(71) Applicant: XEROX CORPORATION, Norwalk, CT (US)

(72) Inventors: Tab A. Tress, Henrietta, NY (US); Brian J. Gills, Penfield, NY (US); Allen J. Thompson, Sodus, NY (US); Michael A. Fayette, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/595,186

(22) Filed: May 15, 2017

(65) Prior Publication Data

US 2018/0032012 A1 Feb. 1, 2018

Related U.S. Application Data

(63) Continuation-in-part of application No. 15/224,300, filed on Jul. 29, 2016, now Pat. No. 9,727,014.

(51) Int. Cl.
*B41M 5/382* (2006.01)
*G03G 13/20* (2006.01)
(Continued)

(52) U.S. Cl.
CPC ..... *B41M 5/3825* (2013.01); *B41J 2/325* (2013.01); *G03G 13/20* (2013.01);
(Continued)

(58) Field of Classification Search
CPC . B41M 5/3825; G03G 15/2053; G03G 13/20; G03G 15/2028; B41J 2/325; B65H 2511/12
See application file for complete search history.

(56) References Cited

U.S. PATENT DOCUMENTS 5,171,969 A 12/1992 Nishimura et al.
6,423,941 B1 7/2002 Kanari et al.
(Continued)

OTHER PUBLICATIONS

Tress et al., U.S. Appl. No. 14/838,005, filed Aug. 27, 2015, entitled "Center Registered Process Direction Heating Element with Temperature Leveling and/or Resistance Increase".
(Continued)

*Primary Examiner* — Susan S Lee
(74) *Attorney, Agent, or Firm* — Caesar Rivise, PC

(57) ABSTRACT

A fuser includes a fuser roll and a pressure roll that forms a nip between the rolls through which a sheet is conveyed to permanently fuse an image onto the sheet. The fuser roll includes a heater element having a single resistive trace, a common trace tapped to a first side of the resistive trace continuous across the resistive trace, and first and second conductive traces tapped to ends of the resistive trace at a second side of the resistive trace opposite the first side. The first and second conductive traces are physically separated and conductively segmented by a conductive gap between the conductive traces. The resistive trace includes a separation gap extending through the resistive trace continuously from the second side of the resistive trace at the conductive gap towards the first side of the resistive trace to prevent current flow between the segmented conductive traces.

20 Claims, 7 Drawing Sheets

(51) Int. Cl.
*G03G 15/20* (2006.01)
*B41J 2/325* (2006.01)

(52) U.S. Cl.
CPC ..... *G03G 15/2028* (2013.01); *G03G 15/2053* (2013.01); *B65H 2511/12* (2013.01)

(56) References Cited

U.S. PATENT DOCUMENTS

| | | | | |
|---|---|---|---|---|
| 6,580,883 | B2 | 6/2003 | Suzumi | |
| 7,193,180 | B2 | 3/2007 | Cook et al. | |
| 7,193,181 | B2 | 3/2007 | Makihira et al. | |
| 7,228,082 | B1 | 6/2007 | Davidson et al. | |
| 9,727,014 | B1 * | 8/2017 | Tress | G03G 15/2028 |
| 2004/0228667 | A1 | 11/2004 | Eskey | |
| 2005/0199610 | A1 * | 9/2005 | Ptasienski | H05B 3/26 219/543 |
| 2016/0018764 | A1 | 2/2016 | Takagi et al. | |
| 2016/0116872 | A1 | 4/2016 | Tress | |
| 2017/0003632 | A1 * | 1/2017 | Jensen | G03G 15/2053 |
| 2017/0060054 | A1 * | 3/2017 | Tress | G03G 15/2057 |

OTHER PUBLICATIONS

Jensen et al., U.S. Appl. No. 15/063,537, filed Mar. 8, 2016, entitled "Method for Temperature Leveling and/or Resistance Increase in Solid Heater".

* cited by examiner

FUSER FOR ELECTROPHOTOGRAPHIC PRINTING HAVING RESISTIVE TRACE WITH GAP

CROSS-REFERENCE TO RELATED APPLICATIONS

This continuation-in-part application claims the benefit under 35 U.S.C. § 120 of U.S. application Ser. No. 15/224,300, filed Jul. 29, 2016, titled "Fuser for Electrophotographic Printing Having Resistive Trace With Gap" and whose entire disclosure is incorporated by reference herein.

FIELD OF DISCLOSURE

This invention relates generally to electrostatographic image printing devices, and more particularly, to a fuser adapted to handle multiple paper widths in the printing devices.

BACKGROUND

In electrostatographic printing, commonly known as xerographic or printing or copying, an important process step is known as "fusing". In the fusing step of the xerographic process, dry marking making material, such as toner, which has been placed in imagewise fashion on an imaging substrate, such as a sheet of paper, is subjected to heat and/or pressure in order to melt and otherwise fuse the toner permanently on the substrate. In this way, durable, non-smudging images are rendered on the substrates.

The most common design of a fusing apparatus as used in commercial printers includes two rolls, typically called a fuser roll and a pressure roll, forming a nip therebetween for the passage of the substrate therethrough. Typically, the fuser roll further includes, disposed on the interior thereof, one or more heating elements, which radiate heat in response to a current being passed therethrough. The heat from the heating elements passes through the surface of the fuser roll, which in turn contacts the side of the substrate having the image to be fused, so that a combination of heat and pressure successfully fuses the image. As shown in U.S. Pat. No. 7,193,180 B2, for example, a resistive heater is disclosed that is adapted for heating a fuser belt with the heater comprising a substrate, a first resistive trace formed over the substrate, and a second resistive trace formed so as to at least partially overlap the first trace.

Provisions can be made in fusers to take into account the fact that sheets of different sizes may be passed through the fusing apparatus, ranging from postcard sized sheets to sheets which extend the full length of the rolls. Further, it is known to control the heating element or elements inside the fuser roll to take into account the fact that a sheet of a particular size is being fed through the nip. For example, U.S. Pat. No. 7,228,082 B1 discloses printing machine that includes a fuser for fusing an image onto a sheet. The fuser includes an endless belt having a plurality of predefined sized fusing areas that are selectively activatable and the plurality of predefined sized fusing areas are arranged in a substantially parallel manner along a process direction of the belt. A means is included for activating one or more of the plurality of predefined sized fusing areas to correspond to one of the selected predefined sized sheets. Multi-tap series controlled ceramic heaters of this design have a flaw in that a conductor interface to the heat-producing materials creates a cold spot which reduces the heater temperature locally and creates a radial cold area in the fuser roll causing image quality issues.

Current center registered solid heaters either require multiple heating traces or a relay to switch between multiple taps on one trace as shown, for example, in U.S. Pat. Nos. 5,171,969; 6,423,941 B1; 6,580,883 and 7,193,181. Multiple heating traces have been shown to hurt heat transfer performance and thus, extendibility since only one heating trace can be in optimal position for heat transfer. Configurations with inter heating trace conductive taps have cold spot that effect and hurt latitudes and require bigger drawer connections with extra pins. Current single heating traces with multiple tap designs require an extra drawer connector pin as compared to multiple trace designs and require either serial control or perfect knowledge of media widths.

SUMMARY

The following presents a simplified summary in order to provide a basic understanding of some aspects of one or more embodiments or examples of the present teachings. This summary is not an extensive overview, nor is it intended to identify key or critical elements of the present teachings, nor to delineate the scope of the disclosure. Rather, its primary purpose is merely to present one or more concepts in simplified form as a prelude to the detailed description presented later. Additional goals and advantages will become more evident in the description of the figures, the detailed description of the disclosure, and the claims.

The foregoing and/or other aspects and utilities embodied in the present disclosure may be achieved by providing a fuser that includes a center registered heater which provides uniformity at the surface of the fuser that contacts an imaged sheet by configuring the heater to include a single resistive heating trace with multiple tap ins for heating different media widths. A tap in is placed right at the center of the heating trace. This line can then serve as a dedicated common when firing the different heating zones. Current from each segment is separated into non-lateral conduction paths preventing an adjacent bleed-down path from impacting life of the conductive elements.

According to aspects illustrated herein, a fuser roll usable in an electrophotographic printing machine is configured to form a nip between the fuser roll and a pressure roll through which a sheet is conveyed to permanently fuse an image onto the sheet. The fuser roll includes a heater element having a single resistive trace, a common trace tapped to a first side of the resistive trace continuous across the resistive trace, and first and second conductive traces tapped to ends of the resistive trace at a second side of the resistive trace opposite the first side. The first and second conductive traces are conductively segmented by a conductive gap between the conductive traces. The resistive trace includes a separation gap extending through the resistive trace continuously from the second side of the resistive trace at the conductive gap towards the first side of the conductive gap and the common trace to prevent current flow between the segmented conductive traces.

Exemplary embodiments are described herein. It is envisioned, however, that any system that incorporates features of apparatus and systems described herein are encompassed by the scope and spirit of the exemplary embodiments.

BRIEF DESCRIPTION OF THE DRAWINGS

Various exemplary embodiments of the disclosed apparatuses, mechanisms and methods will be described, in detail, with reference to the following drawings, in which like referenced numerals designate similar or identical elements, and.

DETAILED DESCRIPTION

Figure 1:
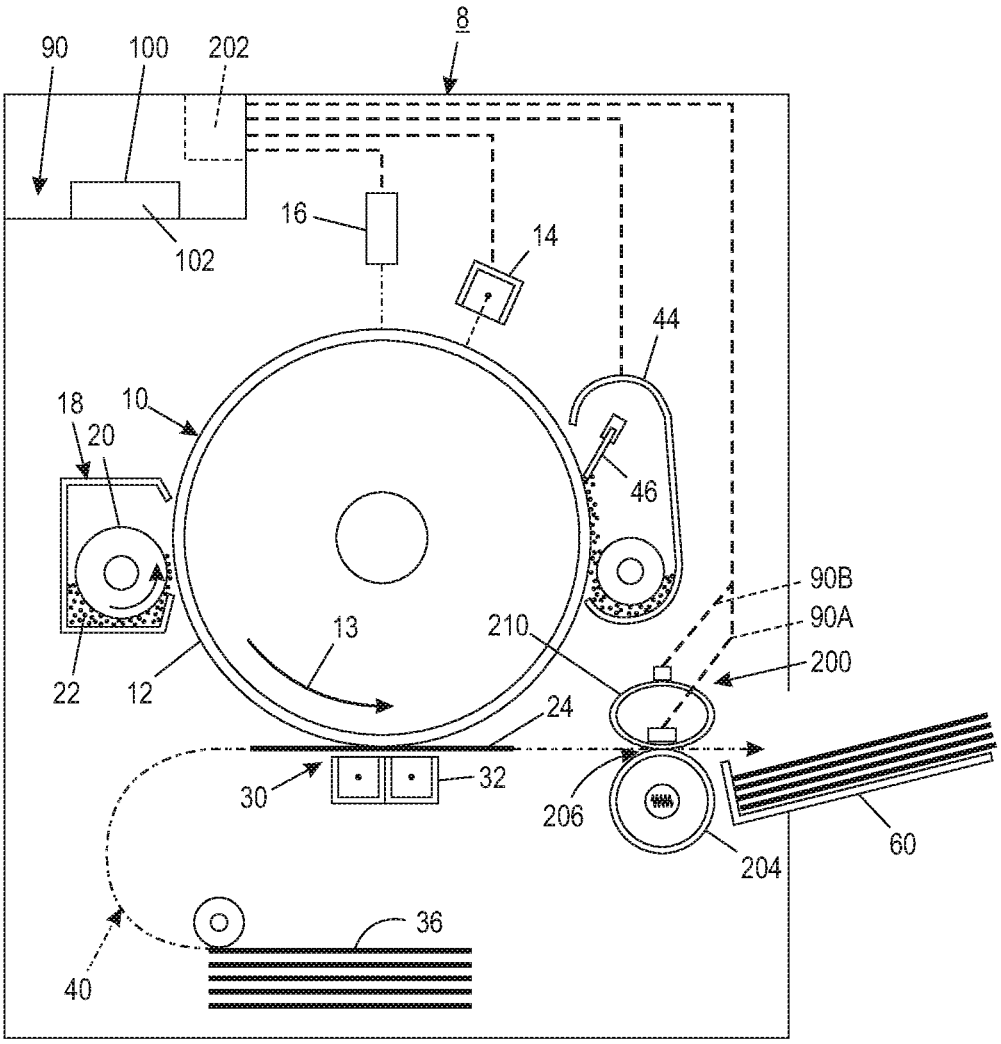
FIG. 1 is an elevational view showing relevant elements of an exemplary toner imaging electrostatographic machine including an embodiment of the fusing apparatus of the present disclosure.

Illustrative examples of the devices, systems, and methods disclosed herein are provided below. An embodiment of the devices, systems, and methods may include any one or more, and any combination of, the examples described below. This invention may, however, be embodied in many different forms and should not be construed as limited to the embodiments set forth below. Rather, these exemplary embodiments are provided so that this disclosure will be thorough and complete, and will fully convey the scope of the invention to those skilled in the art. Accordingly, the exemplary embodiments are intended to cover all alternatives, modifications, and equivalents as may be included within the spirit and scope of the apparatuses, mechanisms and methods as described herein.

The disclosed printer and fuser system may be operated by and controlled by appropriate operation of conventional control systems. It is well known and preferable to program and execute imaging, printing, paper handling, and other control functions and logic with software instructions for conventional or general purpose microprocessors, as taught by numerous prior patents and commercial products. Such programming or software may, of course, vary depending on the particular functions, software type, and microprocessor or other computer system utilized, but will be available to, or readily programmable without undue experimentation from, functional descriptions, such as, those provided herein, and/or prior knowledge of functions which are conventional, together with general knowledge in the software of computer arts. Alternatively, any disclosed control system or method may be implemented partially or fully in hardware, using standard logic circuits or single chip VLSI designs.

We initially point out that description of well-known starting materials, processing techniques, components, equipment and other well-known details may merely be summarized or are omitted so as not to unnecessarily obscure the details of the present disclosure. Thus, where details are otherwise well known, we leave it to the application of the present disclosure to suggest or dictate choices relating to those details. It will be appreciated by respective engineers and others that many of the particular components mountings, component actuations, or component drive systems illustrated herein are merely exemplary, and that the same novel motions and functions can be provided by many other known or readily available alternatives. All cited references, and their references, are incorporated by reference herein in their entireties where appropriate for teachings of additional or alternative details, features, and/or technical background. What is well known to those skilled in the art need not be described herein.

The modifier "about" used in connection with a quantity is inclusive of the stated value and has the meaning dictated by the context (for example, it includes at least the degree of error associated with the measurement of the particular quantity). When used with a specific value, it should also be considered as disclosing that value.

When referring to any numerical range of values herein, such ranges, are understood to include each and every number and/or fraction between the stated range minimum and maximum. The same applies to each other numerical property and/or elemental range set forth herein, unless the context clearly dictates otherwise.

The terms "print media", "print substrate" and "print sheet" generally refers to a usually flexible physical sheet of paper, polymer, Mylar material, plastic, or other suitable physical print media substrate, sheets, webs, etc., for images, whether precut or web fed.

The term "printing device", "imaging machine" or "printing system" as used herein refers to a digital copier or printer, scanner, image printing machine, xerographic device, electrostatographic device, digital production press, document processing system, image reproduction machine, bookmaking machine, facsimile machine, multi-function machine, or generally an apparatus useful in performing a print process or the like and can include several marking engines, feed mechanism, scanning assembly as well as other print media processing units, such as paper feeders, finishers, and the like. A "printing system" may handle sheets, webs, substrates, and the like. A printing system can place marks on any surface, and the like, and is any machine that reads marks on input sheets; or any combination of such machines.

Referring now to FIG. 1, an electrostatographic or toner-imaging machine 8 is shown. As is well known, a charge receptor or photoreceptor 10 having an imageable surface 12 and rotatable in a direction 13 is uniformly charged by a charging device 14 and imagewise exposed by an exposure device 16 to form an electrostatic latent image on the surface 12. The latent image is thereafter developed by a development apparatus 18 that, for example, includes a developer roll 20 for applying a supply of charged toner particles 22 to such latent image. The developer roll 20 may be of any of various designs, such as, a magnetic brush roll or donor roll, as is familiar in the art. The charged toner particles 22 adhere to appropriately charged areas of the latent image. The surface of the photoreceptor 10 then moves, as shown by the arrow 13, to a transfer zone generally indicated as 30. Simultaneously, a print sheet 24 on which a desired image is to be printed is drawn from sheet supply stack 36 and conveyed along sheet path 40 to the transfer zone 30.

At the transfer zone 30, the print sheet 24 is brought into contact or at least proximity with a surface 12 of photoreceptor 10, which at this point is carrying toner particles thereon. A corotron or other charge source 32 at transfer zone 30 causes the toner image on photoreceptor 10 to be electrostatically transferred to the print sheet 24. The print sheet 24 is then forwarded to subsequent stations, as is familiar in the art, including the fusing station having a high precision-heating and fusing apparatus 200 of the present disclosure, and then to an output tray 60. Following such transfer of a toner image from the surface 12 to the print sheet 24, any residual toner particles remaining on the surface 12 are removed by a toner image baring surface cleaning apparatus 44 including, for example, a cleaning blade 46.

As further shown, the reproduction machine 8 includes a controller or electronic control subsystem (ESS), indicated generally by reference numeral 90 which is preferably a programmable, self-contained, dedicated mini-computer having a central processor unit (CPU), electronic storage 102, and a display or user interface (UI) 100. At UI 100, a user can select one of the pluralities of different predefined sized sheets to be printed onto. The conventional ESS 90, with the help of sensors, a look-up table 202 and connections, can read, capture, prepare and process image data such as pixel counts of toner images being produced and fused. As such, it is the main control system for components and other subsystems of machine 8 including the fusing apparatus 200 of the present disclosure.

Figure 2:
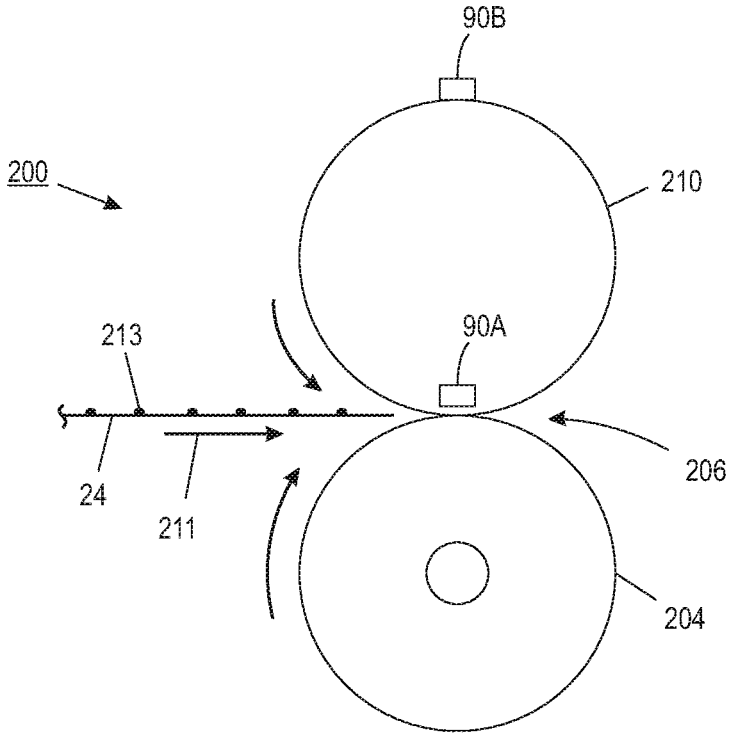
FIG. 2 is an enlarged schematic end view of the fusing apparatus of FIG. 1.

Referring now to FIG. 2, the fusing apparatus 200 of the present disclosure is illustrated in detail and is suitable for uniform and quality heating of unfused toner images 213 in the electrostatographic reproducing machine 8. As illustrated, fusing apparatus 200 includes a rotatable pressure member 204 that is mounted forming a fusing nip 206 with a fuser belt member such as a fuser roll 210. Heater 90A is positioned in contact with the inner diameter of fuser roll 210. Heater 90B is optional as required by design configuration. A copy sheet 24 carrying an unfused toner image 213 thereon can thus be fed in the direction of arrow 211 through the fusing nip 206 for high quality fusing.

Figure 3:
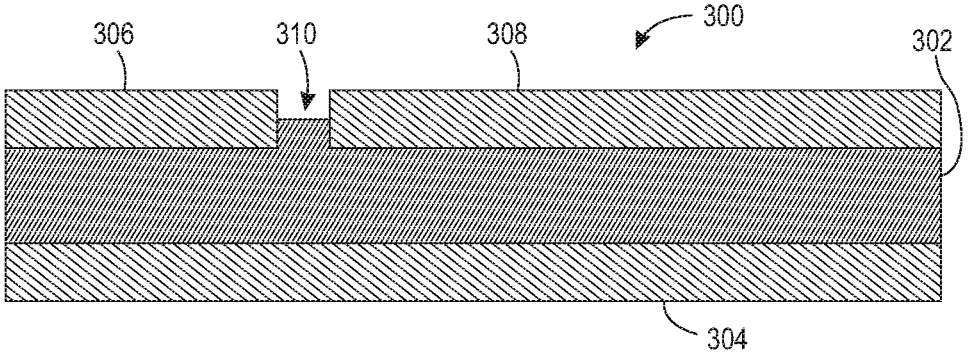
FIG. 3 is plan view of a related art heater portion of the first embodiment of the fuser of FIG. 2 that employs a single resistive trace with multiple tap ins for heating different media widths.

FIG. 3 depicts a related art element of heater 90A. The heater element 300 uses a single solid resistive trace 302 across the entire element with multiple tap ins configured for heating different media widths. The resistive trace 302 is printed resistance that may be mounted on a ceramic substrate (not shown) or other suitable structure that can accommodate a heating element. The printed resistive trace 302 is made from resistive ink that may be deposited on a print layout on the ceramic substrate. As well understood by a skilled artisan, a variety of electrical elements can be printed with electrically functional inks; such elements can be fashioned to exhibit certain dielectric, resistive, conductive, and semi-conductive properties. The resistive trace may be manufactured with resistive ink and the conductive paths with conductive ink.

The resistive trace 302 has conductive paths on both sides of the resistive trace. Opposite ends of the resistive trace can have different levels of resistivity for serial control. A single conductive trace may be continuous across the heater element 300 and referred to as the common 304 is connected along the entire resistive trace 302 to serve as a dedicated common when firing the different heating zones. By placing a common along the entire resistive trace 302, a dedicated common line that does not have to be switched around when firing different heating zones is provided, which allows for the benefits of a single trace design well.

Separate segmented conductive traces 306, 308 are heating elements connected to the ends of the resistive trace 302 to allow heating for different paper widths corresponding to A3 and A4 sheets and the like. In other words, the conductive traces 306, 308 are segmented so that only certain portions of the heater element 300 are heated depending, for example, on the substrate being used. For example, a small segmented conductive trace at one end of the fuser can be de-energized when A4 paper is being used instead of letter size. This extends the life of the heater 90A, the fuser belt or roll 210 and the pressure member or roll 204. The conductive traces 306, 308 are separated by a conductive trace gap 310 (e.g., about 0.75 mm) that is small enough to alleviate cold spot concerns between the conductive traces. It should be understood that heater 90A is conventionally heated by applying voltage (e.g., 120 volts) at connector pads coupled to the conductive traces. The common trace may be maintained at a common voltage, such as, 0 volts. The conductive traces 306, 308 may be controlled at different voltages, such as 0 volts and 120 volts, depending on what traces are heated, for example, in accordance with different paper sizes.

The related art heater element 300 is an example of the heater 90A described in greater detail in U.S. patent application Ser. No. 14/838,005, filed Aug. 27, 2015, and Ser. No. 15/063,537, filed Mar. 8, 2016, both of which are commonly assigned, and the disclosures of which are hereby incorporated by reference herein in their entirety. The inventors have discovered that the heater element design shown in FIG. 3 works without issue when there is no potential difference between the conductive traces 306, 308. However, when there is a potential difference between adjacent conductive traces, for example when one of the conductive traces 308 is heated while an adjacent conductive trace 306 is not, current can leak into the non-heated conductive trace from the heated conductive trace and prevent the non-heated conductive trace from being de-energized. In other words, when one conductive trace has its potential reduced the other trace continues to feed the reduced trace through lateral current flow across the conductive trace gap that separates the conductive traces. This undesired lateral current flow across the conductive trace gap can create a defect leading to a burn-out path that may even appear as an electric arc stemming from the conductive trace gap. The adjacent non-powered conductive trace is bled by its associated heating resistor and is fed through the resistive trace 302 between the two. This causes premature burnout issues with the heater element, and fuser roll and belt member.

Figure 4:
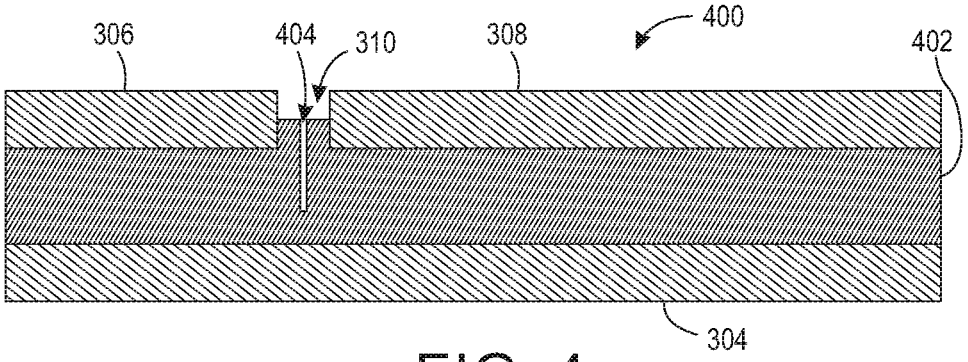
FIG. 4 is plan view of a heater portion of a fuser in accordance with exemplary embodiments.

The inventors have eliminated this issue by implementing a current pathway gap that removes lateral current across the conductive trace gap. Thus, current from each conductive trace 306, 308 is separated into non-lateral conduction paths preventing the adjacent bleed-down path from causing burn-out issues. FIG. 4 depicts a heater element 400 similar to the heater element 300 of FIG. 3. The heater element 400 includes a solid resistive trace 402 made from resistive ink that may be deposited on a print layout on the ceramic substrate (e.g., aluminum nitride) across the entire element of heater 90A. The resistive trace 402 includes an open or continuous separation gap 404 extending from the conductive trace gap 310 into the resistive trace in a medial direction towards the common conductive trace 304. The term medial direction corresponds to the direction across the resistive trace perpendicular to the side of the resistive trace from which the separation gap originates, that is, directly across the resistive trace.

Figure 10:
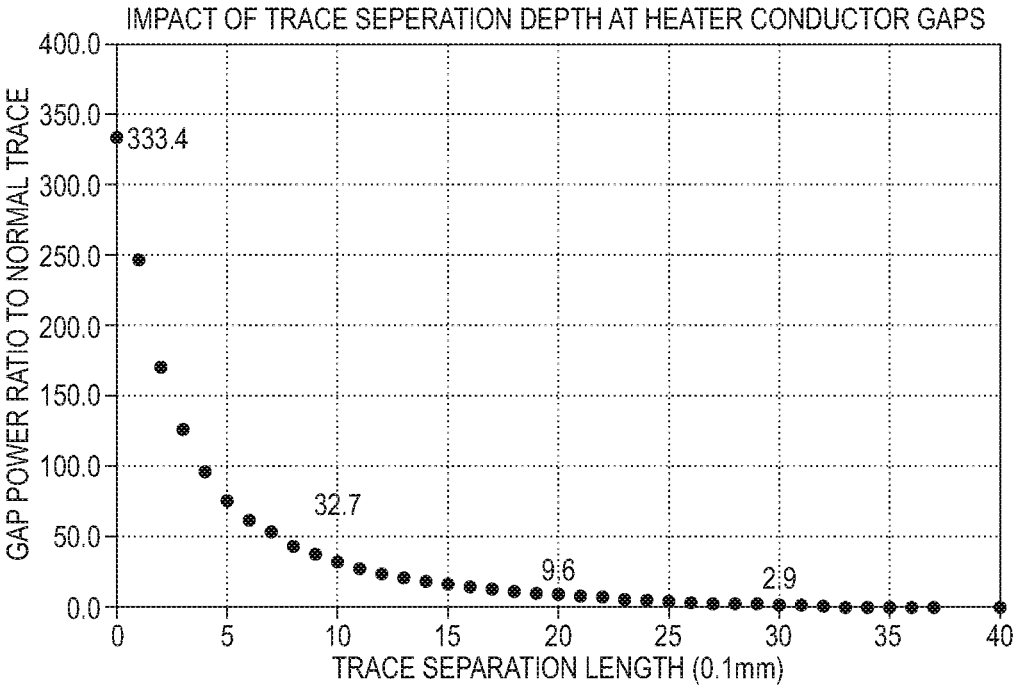
FIG. 10 is a graph showing impact of trace separation depth.

While not being limited to a particular theory, the separation gap 404 may extend at least half way across the resistive trace towards the common. However, the invention is not limited to half way across the resistive trace, as a separation gap of less than 50% is also within the scope of the invention. For example, as can be seen in FIG. 10 described in greater detail below, while a gap of 50% may reduce lateral current across the conductive trace gap by about 99%, a gap of 40% may reduce lateral current by about 97%, a gap of 20% may reduce lateral current by about 90%, and a gap of 10% may reduce lateral current by about 80%. Accordingly separation gaps much smaller than 50% are considered within the scope of the invention providing a solution to adjacent bleed-down path issues.

It is understood that the dimensions of the heater elements are by example only, and do not limit the scope to any particular dimension. In the exemplary heater element shown in FIG. 4, the heater element 400 is a portion of the heater 90A, which may have a length across of about 350 mm and a width up and down of about 12 mm. While not being limited to a particular size, the conductive traces 306, 308 and common conductive trace 304 may have a width of about 1.75 mm and a medial distance between the conductive traces 306, 308 directly across to the common 304 may be about 5.25 mm. It is understood that the common trace continuous across the heater element may not be unitary. However, if there are any gaps in the common trace, the trace may be spliced together to become a continuous trace, as readily understood by a skilled artisan.

The separation gap may be very narrow as long as the gap is continuous, and can be filled with a dielectric material. In FIG. 4, the separation gap 404 may be less than 1 mm wide, and may be about 0.25 mm-0.5 mm wide having a length any distance across the resistive trace 402, with consideration possibly depending on how much, if any, lateral current flow across the conductive trace gap of about 0.75 mm is allow to alleviate cold spot concerns. For a distance between the conductive traces 306, 308 and the common 304 of 5.25 mm, the separation gap 404 may be at least 0.5 mm, at least 1.0 mm, at least 2.0 mm, or any distance up to the medial width (e.g., up and down, across the resistive trace, vertical in FIG. 4) of the resistive trace. FIG. 10 illustrates the impact of trace separation length across a 5.25 mm solid resistive trace 402. As can be seen, a separation gap 404 of 1.0 mm reduces gap power ratio to normal trace by over 90%, a separation gap of 2.0 mm reduces gap power ratio to normal trace by over 97%, and a separation gap of 3.0 mm reduces gap power ratio to normal trace by over 99%.

Figure 7:
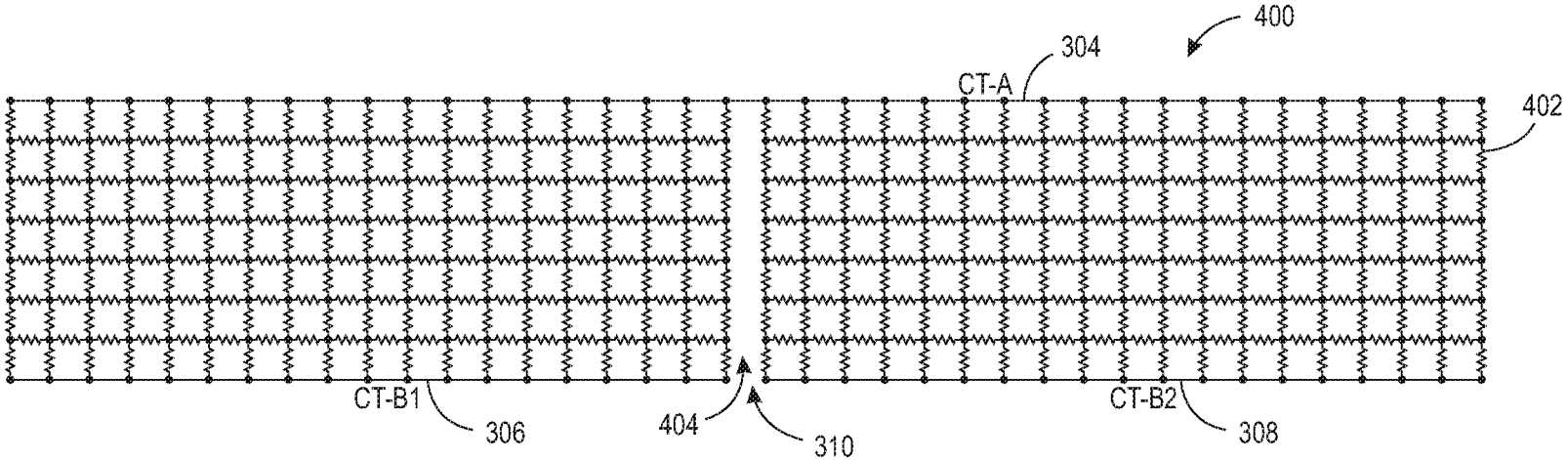
FIG. 7 is circuit diagram corresponding to the exemplary heater portion of FIG. 4.

FIG. 7 depicts the heater element 400 in circuit view, with CT-A corresponding to the common conductive trace 304, CT-B1 corresponding to conductive trace 306, and CT-B2 corresponding to conductive trace 308. The resistive trace 402 is shown across the heater element with the separation gap 404 at the conductive trace gap 310. The separation gap 404 eliminates a lateral current path and adjacent bleed down paths between the conductive traces 306 (CT-B1) and 308 (CT-B2), which may be energized at different times to provide temperature uniformity for cross process width heating of different sized substrates (e.g., A4, A3, letter, envelope).

A method of making the heater element 400 may include depositing (e.g., via silk screening) resistive ink in a print layout on a ceramic substrate (e.g., aluminum nitride) to form the resistive trace 402. The print layout includes a separation gap in the resistive ink defining separations providing heating zones. Solid sections on both sides of the resistive trace are overprinted with conductive trace material to provide uniform voltage across the sections. The conductive traces 306, 308 and conductive common 304 are then attached to connector pads (not shown) on each end to provide a mating surface for the connection points. The connector pads for the conductive traces 306 may also receive voltage from a voltage driver. All areas, excluding conductive connection points, may be overcoated with dielectric as readily understood by a skilled artisan. The dielectric may fill in the resistive trace separation gap 404 and the conductive trace gap 310 to help minimize undesired lateral current flow.

Accordingly, the separation gap 404 may be created during formation of the resistive trace 402, for example during the resistive ink deposition onto the substrate, which may be carried out by silk screening. The separation gap may also be created after formation of the resistive trace, for example by removing resistive ink from the formed resistive trace to leave a gap in the trace. Resistive ink may be removed from the formed resistive trace by a removal process, such as by grinding, etching or laser trimming, as readily understood by a skilled artisan.

Figure 5:
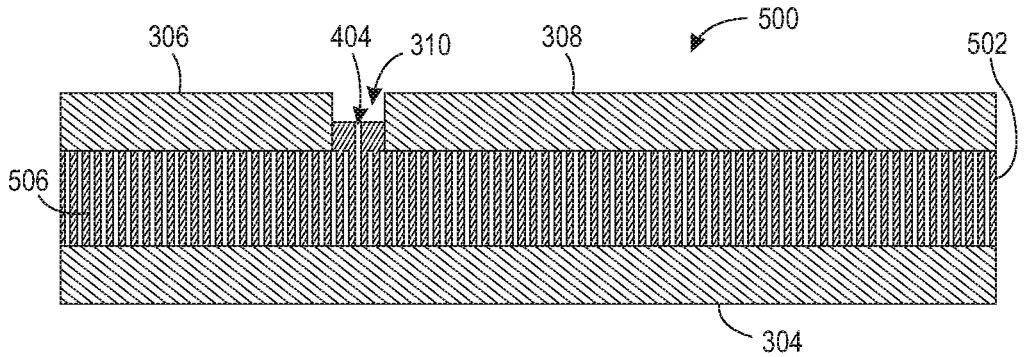
FIG. 5 is plan view of a heater portion of a fuser in accordance with exemplary embodiments.

FIG. 5 depicts a heater element 500 similar to the heater element 400 of FIG. 4. In particular, the heater element 500 removes a lateral current pathway between adjacent heating segments with a center main resistor with a line array pattern to eliminate resistor path directly between same side conductors. For example, the heater element 500 includes a line array resistive trace 502 made from resistive ink that may be deposited in a medial line array pattern 506 across the resistive trace on a print layout on a ceramic substrate (e.g., aluminum nitride) across the entire element of heater 90A. The resistive trace 502 includes the open or continuous separation gap 404 extending from the conductive trace gap 310 into the resistive trace in a process direction towards the common conductive trace 304. The separation gap 404 may be about 0.25 mm-0.5 mm wide having a length any distance across the resistive trace 502. In fact the separation gap 404 may extend in the process direction between lines in the line array pattern 506.

A method of making the heater element 500 may include depositing (e.g., via silk screening) resistive ink in a line array print layout on a ceramic substrate to form the line array resistive trace 502. The resistive line arrays are joined on each side by a solid section, preferably of the same resistive material with a defined separation gap 304 defining heating zones on opposite sides of the separation gap. Solid sections on both sides of the resistive trace are overprinted with conductive trace material to provide uniform voltage across the lines in the array. The conductive traces 306, 308 and conductive common 304 are then attached to connector pads (not shown) on each end to provide a mating surface for the connection points. All areas, excluding conductive connection points, may be overcoated with dielectric as readily understood by a skilled artisan. The dielectric may fill in the resistive trace separation gap 404 and the conductive trace gap 310 to help minimize undesired lateral current flow.

Figure 8:
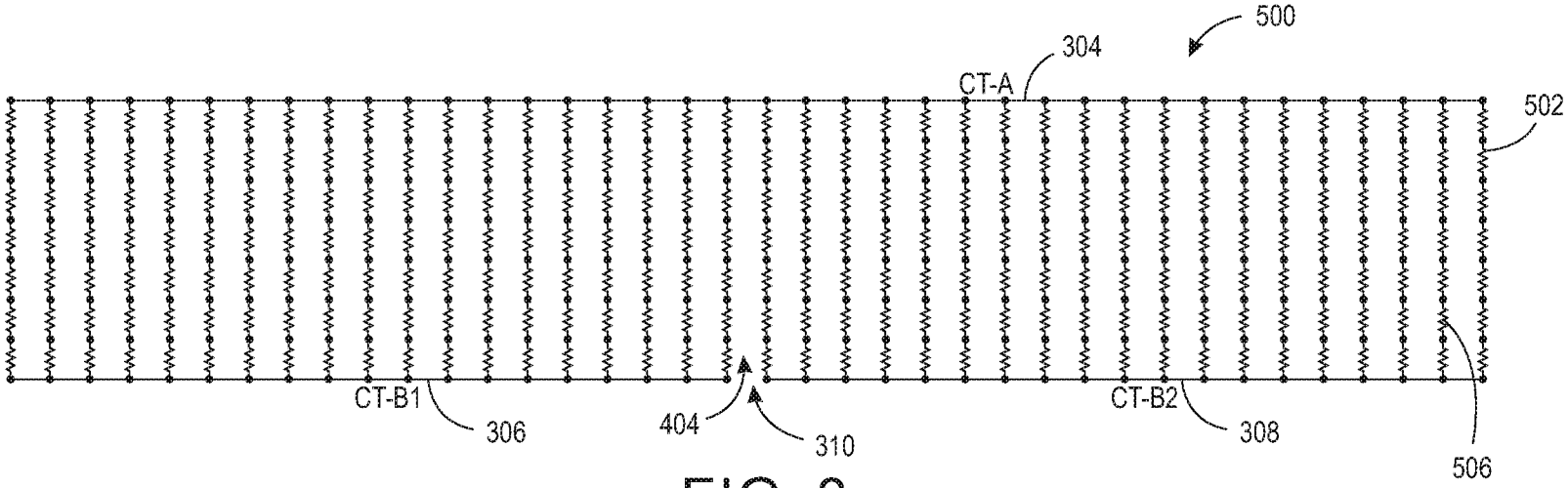
FIG. 8 is circuit diagram corresponding to the exemplary heater portion of FIG. 5.

FIG. 8 depicts the heater element 500 in circuit view, with CT-A corresponding to the common conductive trace 304, CT-B1 corresponding to conductive trace 306, and CT-B2 corresponding to conductive trace 308. The line array resistive trace 502 is shown across the heater element with the separation gap 404 at the conductive trace gap 310. The line array pattern 506 of the line array resistive trace 502 uses lower ink bulk resistivity than the solid resistive trace 402 and eliminates later current paths in the resistive trace. The separation gap 404, which may extend between lines in the line array pattern 506 as can be seen in FIG. 7, eliminates a lateral current path and adjacent bleed down paths between the conductive traces 306 (CT-B1) and 308 (CT-B2), which again may be energized at different times to provide temperature uniformity for cross process width heating of different sized substrates (e.g., A4, A3, letter, envelope).

Figure 6:
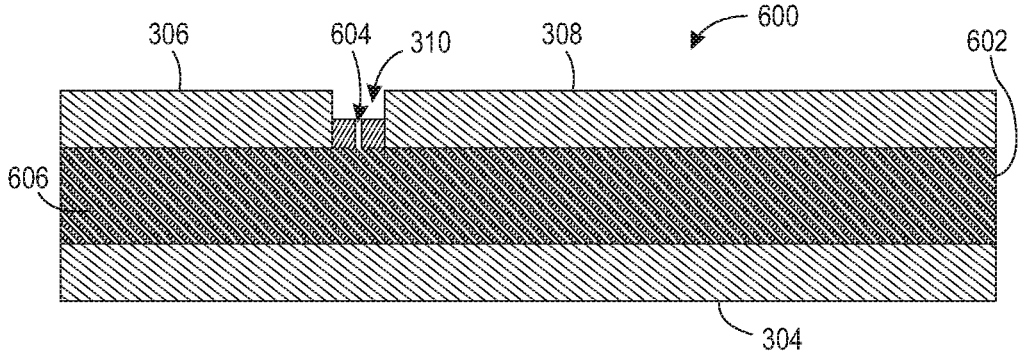
FIG. 6 is plan view of a heater portion of a fuser in accordance with exemplary embodiments.

FIG. 6 depicts a heater element 600 similar to the heater element 400 of FIG. 4. In particular, the heater element 600 removes a lateral current pathway between adjacent heating segments with a center main resistor with an angled line array pattern to eliminate resistor path directly between same side conductors while also eliminating cold section concerns. For example, the heater element 600 includes an angled line array resistive trace 602 made from resistive ink that may be deposited in an angled line array pattern 606 on a print layout on the ceramic substrate (e.g., aluminum nitride) across the entire element of heater 90A. The resistive trace 602 includes the open or continuous separation gap 404 extending from the conductive trace gap 310 into the resistive trace towards the common conductive trace 304. The angle of the angled lines of the array may be any angle greater between zero and 90 degrees from the medial direction directly across the angled line array resistance trace 60, with an angle less than 60 degrees preferred to avoid lengthening the array lines and any inefficiencies therefrom.

A separation gap 604 similar to the separation gap 404 may be less than 1.0 mm wide and about 0.25 mm-0.5 mm wide having a length any distance across the resistive trace 602. In fact the separation gap 604 may extend in the process direction between lines in the angled line array pattern 606. While the heater element 600 shows the separation gap 604 extending medially directly across the resistive trace 602, it should be understood that the separation gap 604 may extend from the conductive gap 310 in any angle towards the common 304. The separation gap 604 may extend between lines in the angled line array pattern 606 as can be seen in FIG. 6.

Similar to the heater element 500 discussed above, the heater element 600 with the angled line array resistive trace 602 eliminates lateral current paths and adjacent bleed down paths between the conductive traces 306 and 308. In addition, with the angled line resistive array, the heater element 600 eliminates a possible cold section between the conductive traces 306 and 308. A method of making the heater element 600 is substantially similar to the method for making the heater element 500. However, the method of making the heater element 600 may include depositing (e.g., via silk screening) resistive ink in an angled line array print layout on a ceramic substrate (e.g., aluminum nitride) to form the angled line array resistive trace 602.

Figure 9:
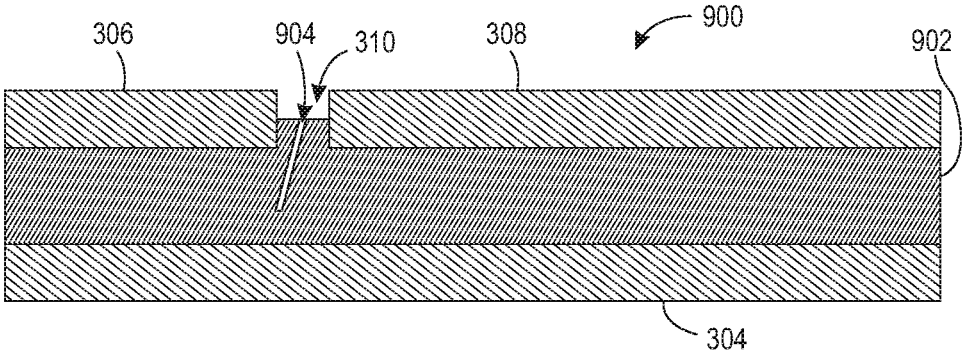
FIG. 9 is plan view of a heater portion of a fuser in accordance with exemplary embodiments.

FIG. 9 depicts a heater element 900 similar to the heater element 400 of FIG. 4, with the major difference being that the separation gap is angled instead of medially across the resistive trace. The heater element 900 includes a solid resistive trace 902 made from resistive ink that may be deposited on the ceramic substrate across the entire element of heater 90A. The resistive trace 902 includes an open or continuous separation gap 904 extending from the conductive trace gap 310 into the resistive trace at an angle off of the medial direction directly towards the common conductive trace 304.

While not being limited to a particular theory, the separation gap 904 may extend continuously at least half way across the resistive trace 902 towards the common. However, the invention is not limited to half way across the resistive trace, as a separation gap of less than 50% is also within the scope of the invention. As with the separation gaps discussed above, the separation gap 904 may be less than 1.0 mm wide and about 0.25 mm-0.5 mm wide. The heater element 900 removes undesired lateral current flow between adjacent conductive traces 306, 308 as discussed above with the heater element 400. In addition, by inserting the separation gap 904 at an angle, the heater element 900 eliminates a possible cold section between the conductive traces 306 and 308.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art.

What is claimed is:

1. A heater element useable in a fuser roll, the fuser roll configured to form a nip between the fuser roll and a pressure roll through which a sheet is conveyed to permanently fuse an image onto the sheet, the heater element comprising a resistive trace, a common trace tapped to a first side of the resistive trace continuous across the resistive trace, and first and second conductive traces tapped to ends of the resistive trace at a second side of the resistive trace opposite the first side, the first and second conductive traces conductively segmented by a conductive gap between the conductive traces, the resistive trace including a separation gap extending through the resistive trace from the second side of the resistive trace at the conductive gap towards the first side of the resistive trace to prevent current flow between the segmented conductive traces.

2. The heater element of claim 1, wherein the conductive gap extends along a process direction of the current across the resistive trace towards the first side.

3. The heater element of claim 1, wherein the conductive gap extends at least half way across the resistive trace towards the first side.

4. The heater element of claim 1, wherein the conductive gap extends through the resistive trace towards the first side at an angle at most 45 degrees from a medial line directly across the resistive trace.

5. The heater element of claim 1, wherein the resistive trace is arraigned in a line array pattern, the resistive trace including resistive ink in a line array print, and the conductive gap extends between two lines in the line array print.

6. A fuser roll usable in an electrophotographic printing machine, the fuser roll configured to form a nip between the fuser roll and a pressure roll through which a sheet is conveyed to permanently fuse an image onto the sheet, the fuser roll comprising a heater element having a resistive trace, a common trace tapped to a first side of the resistive trace continuous across the resistive trace, and first and second conductive traces tapped to ends of the resistive trace at a second side of the resistive trace opposite the first side, the first and second conductive traces conductively segmented by a conductive gap between the conductive traces, the resistive trace including a separation gap extending through the resistive trace from the second side of the resistive trace at the conductive gap towards the first side of the resistive trace to prevent current flow between the segmented conductive traces.

7. The fuser roll of claim 6, wherein the conductive gap extends along a process direction of the current across the resistive trace towards the first side.

8. The fuser roll of claim 6, wherein the conductive gap extends at least half way across the resistive trace towards the first side.

9. The fuser roll of claim 6, wherein the conductive gap extends through the resistive trace towards the first side at an angle at most 45 degrees from a medial line directly across the resistive trace.

10. The fuser roll of claim 6, wherein the resistive trace is arraigned in a line array pattern, the resistive trace including resistive ink in a line array print, and the conductive gap extends between two lines in the line array print.

11. A method of making a heater element useable in a fuser roll, the fuser roll configured to form a nip between the fuser roll and a pressure roll through which a sheet is conveyed to permanently fuse an image onto the sheet, the method comprising:

a) forming a resistive trace having a first side and a second side distal the first side;

b) creating a separation gap in the resistive trace defining separate heating zones;

c) tapping a common trace to the first side of the resistive trace continuous across the first side of the resistive trace; and d) tapping first and second conductive traces to ends of the resistive trace at the second side of the resistive trace opposite the first side, the first and second conductive traces conductively segmented by a conductive gap between the conductive traces, the separation gap extending through the resistive trace from the second side of the resistive trace at the conductive gap towards the first side of the resistive trace to prevent current flow between the segmented conductive traces.

12. The method of claim 11, further comprising positioning the heater element in contact with an inner diameter of the fuser roll.

13. The method of claim 11, wherein the step a) includes silk screening the resistive trace in a print layout.

14. The method of claim 11, wherein the step a) includes silk screening the resistive trace in a line array print layout.

15. The method of claim 11, wherein the step a) includes silk screening the resistive trace in an angled line array print layout.

16. The method of claim 11, wherein the separation gap is created during the step of forming the resistive trace.

17. The method of claim 11, wherein the step b) includes grinding a slot in the resistive trace to create the separation gap.

18. The method of claim 11, wherein the step b) includes cutting the resistive trace with a laser to define the separation gap.

19. The method of claim 11, further comprising coating the separation gap and the conductive gap with a dielectric to minimize current flow across the gaps.

20. The method of claim 11, the step b) further comprising eliminating any cold section between the first and second conductive traces by creating the separation gap at an angle greater than zero degrees from a medial line directly across the resistive trace.

* * * * *